US007631857B2

(12) United States Patent
Hunkeler et al.

(10) Patent No.: US 7,631,857 B2
(45) Date of Patent: Dec. 15, 2009

(54) METHOD AND APPARATUS FOR PRODUCING NEWSPAPERS

(75) Inventors: Franz Hunkeler, Zofingen (CH); Dominik Scheidegger, Vordemwald (CH)

(73) Assignee: Hunkeler AG, Wikon (CH)

( * ) Notice: Subject to any disclaimer, the term of this patent is extended or adjusted under 35 U.S.C. 154(b) by 197 days.

(21) Appl. No.: 11/449,727

(22) Filed: Jun. 9, 2006

(65) Prior Publication Data

US 2006/0288891 A1 Dec. 28, 2006

(30) Foreign Application Priority Data

Jun. 16, 2005 (EP) ..... 05012962

(51) Int. Cl.
*B41F 13/54* (2006.01)

(52) U.S. Cl. ..... 270/5.03; 270/5.02; 270/10; 270/11; 270/20.1; 270/21.1; 270/52.07; 270/52.09

(58) Field of Classification Search ..... 270/5.02, 270/5.03, 10, 11, 20.1, 21.1, 52.07, 52.09; 101/227

See application file for complete search history.

(56) References Cited

U.S. PATENT DOCUMENTS

| | | | | |
|---|---|---|---|---|
| 2,173,978 | A | 9/1939 | Pennebaker | |
| 2,797,084 | A | 6/1957 | Hilgoe | |
| 3,983,679 | A * | 10/1976 | Zemke | 53/397 |
| 4,340,212 | A * | 7/1982 | Simson | 270/5.01 |
| 5,303,909 | A | 4/1994 | Maylaender | |
| 5,522,586 | A * | 6/1996 | Bennett et al. | 270/8 |
| 6,139,003 | A | 10/2000 | Michalik et al. | |
| 2001/0037737 | A1 | 11/2001 | Koppelkamm et al. | |
| 2002/0065183 | A1 | 5/2002 | Luthi et al. | |
| 2002/0065184 | A1 | 5/2002 | Graber et al. | |
| 2004/0214707 | A1 | 10/2004 | Stocklossa et al. | |

FOREIGN PATENT DOCUMENTS

DE 100 46 261 A1 3/2002

(Continued)

*Primary Examiner*—Gene Crawford
*Assistant Examiner*—Leslie A Nicholson, III
(74) *Attorney, Agent, or Firm*—Oliff & Berridge, PLC

(57) ABSTRACT

For the production of different types of newspapers, the material web printed in a digital printing system (2) passes through a further processing system (3), whose most important structural units are a side edge cutting station (4), a longitudinal cutting station (5), a crosscutting station (6), a first collecting station (8), a crossfolding station (10), a longitudinal folding station (11), a stitching station (12), a second collecting station (13) and a delivery station (14). The sheets separated from the material web in the crosscutting station (6) are placed on one another in the first collecting station (8) to form sections. These sections are folded transversely with respect to the direction of movement (Y) in the crossfolding station (10). In the longitudinal folding station (11), the sections are folded in their direction of movement (Y). In the stitching station (12), the sheets of a section are joined to one another along the longitudinal fold. In the second collecting station (13), a plurality of sections are inserted into one another. The side edge cutting station (4), the longitudinal cutting station (5), the crossfolding station (10), the stitching station (12) and the second collecting station (13) can be deactivated from case to case, depending on the format and/or composition of the newspaper to be produced in each case.

14 Claims, 10 Drawing Sheets

FOREIGN PATENT DOCUMENTS

| | | | | |
|---|---|---|---|---|
| EP | 0 257 390 | A | | 3/1988 |
| EP | 1 209 000 | A1 | | 5/2002 |
| EP | 1 213 245 | A | | 6/2002 |
| EP | 1 471 022 | A | | 10/2004 |
| GB | 399 538 | A | | 10/1933 |
| JP | 57009670 | A | * | 1/1982 |

* cited by examiner

METHOD AND APPARATUS FOR PRODUCING NEWSPAPERS

The present invention relates to a method for producing newspapers which comprise at least one section which is formed from a number of folded printed sheets lying inside one another, and also an apparatus for implementing this method.

EP-A-1 209 000 discloses a method and an apparatus for producing newspapers in which successive regions of a material web are printed one after another in a digital printer. Each of these regions corresponds to one sheet of a section of a newspaper. By means of crosscutting, the printed sheets are separated from the material web. The sheets of a section are placed on one another and subsequently folded in the transverse direction. A plurality of sections consisting of folded sheets are then placed on one another to form a stack of sections. In order to produce the finished newspaper, the sections of this stack of sections are finally folded centrally.

The present invention is now based on the object of providing a method and an apparatus of the type mentioned at the beginning which make it possible to produce newspapers of different types without interrupting continuous production.

According to the invention, this object is achieved by a method having the features of claim 1 and by an apparatus having the features of claim 12.

A material web is printed in a digital printing system in accordance with the respective end product and subsequently fed to a further processing system, in which the material web is cut into sheets. The further processing system has a number of stations in which the sheets are placed on one another to form sections and are folded. Individual ones of these stations can be deactivated from case to case, so that no processing takes place in the deactivated stations. This permits the production of various types of newspapers which differ from one another, for example with respect to format and/or composition, without the continuous production process having to be interrupted for the purpose of making changes.

Preferred further refinements of the method according to the invention and of the apparatus according to the invention form the subject matter of the dependent claims.

Figure 1:
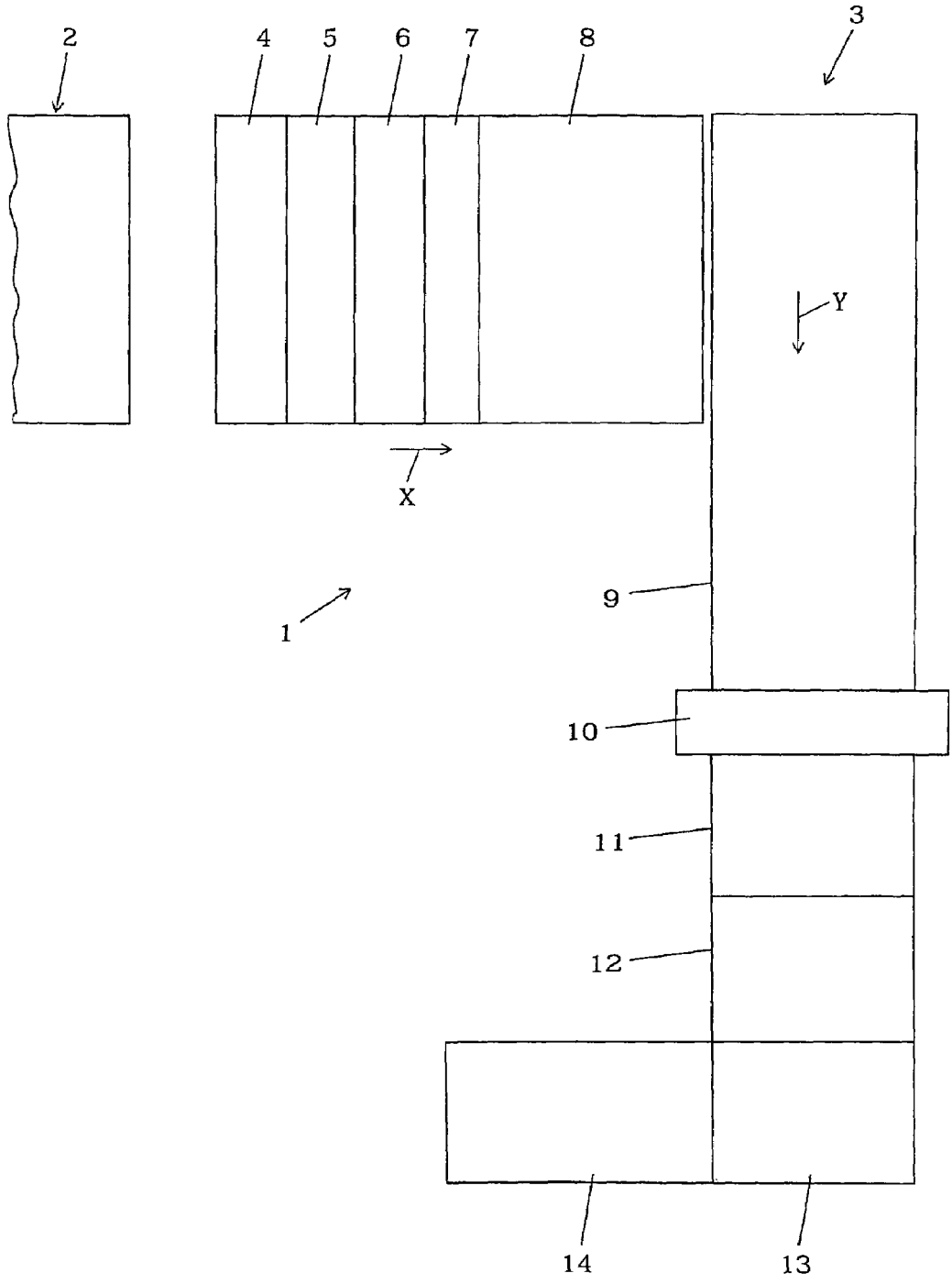
Figure 2:
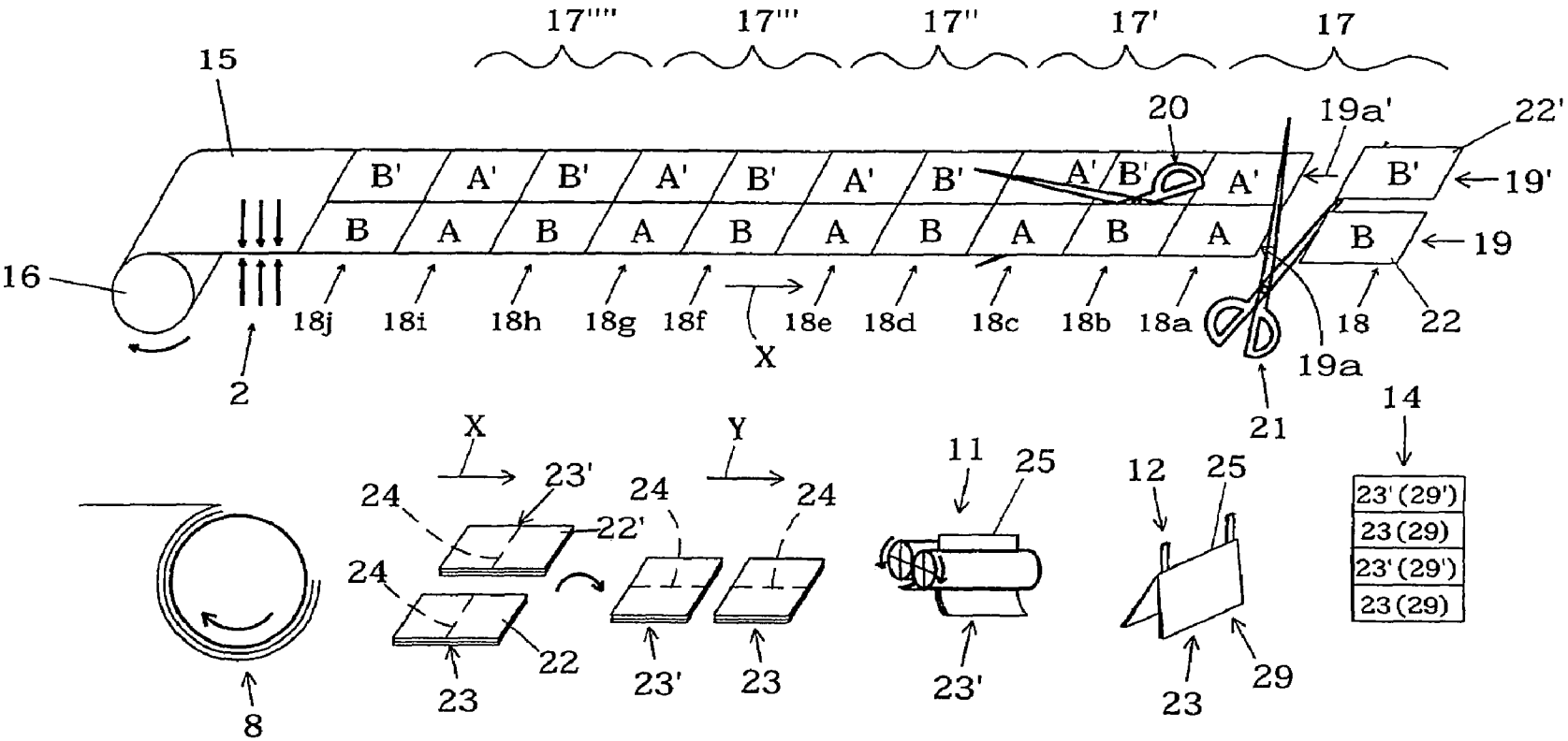
Figure 3:
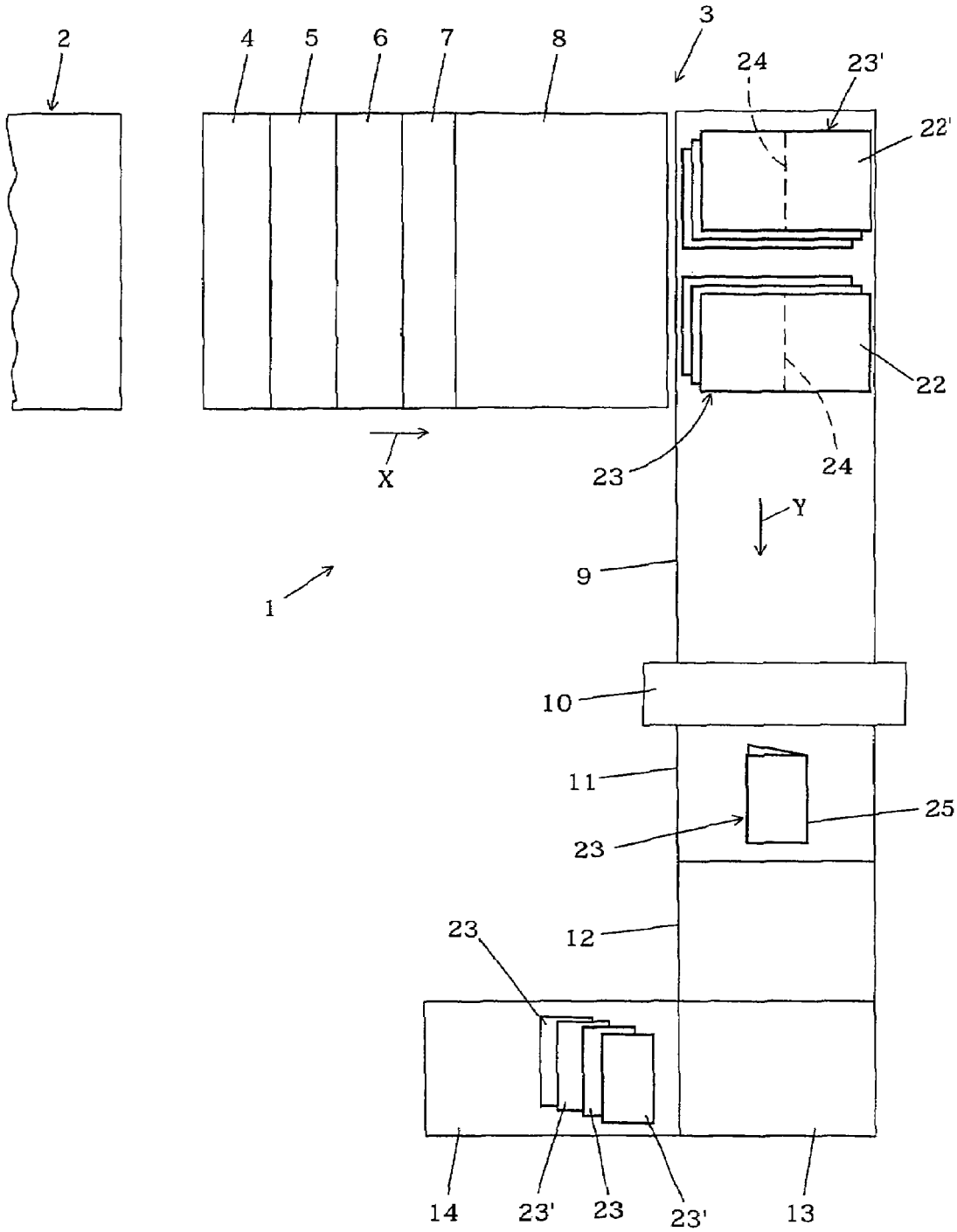
Figure 4:
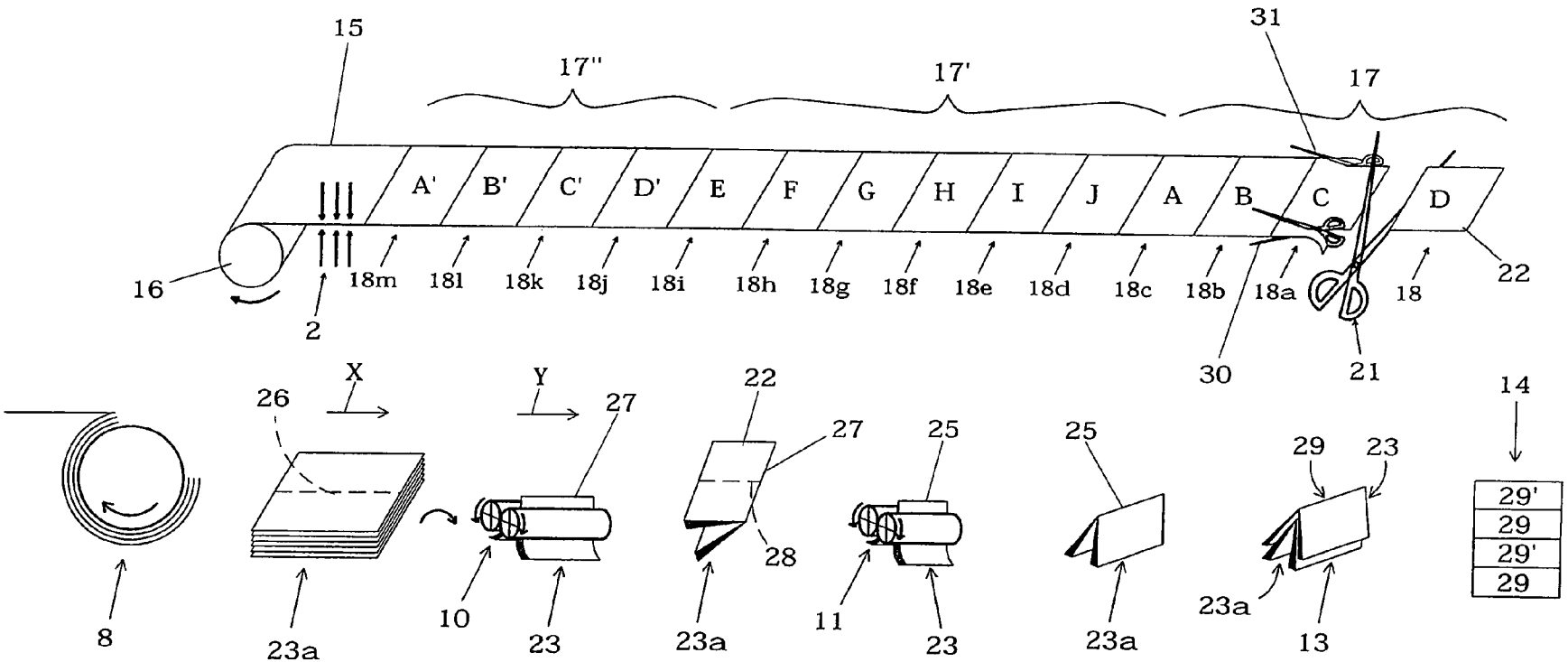
Figure 5:
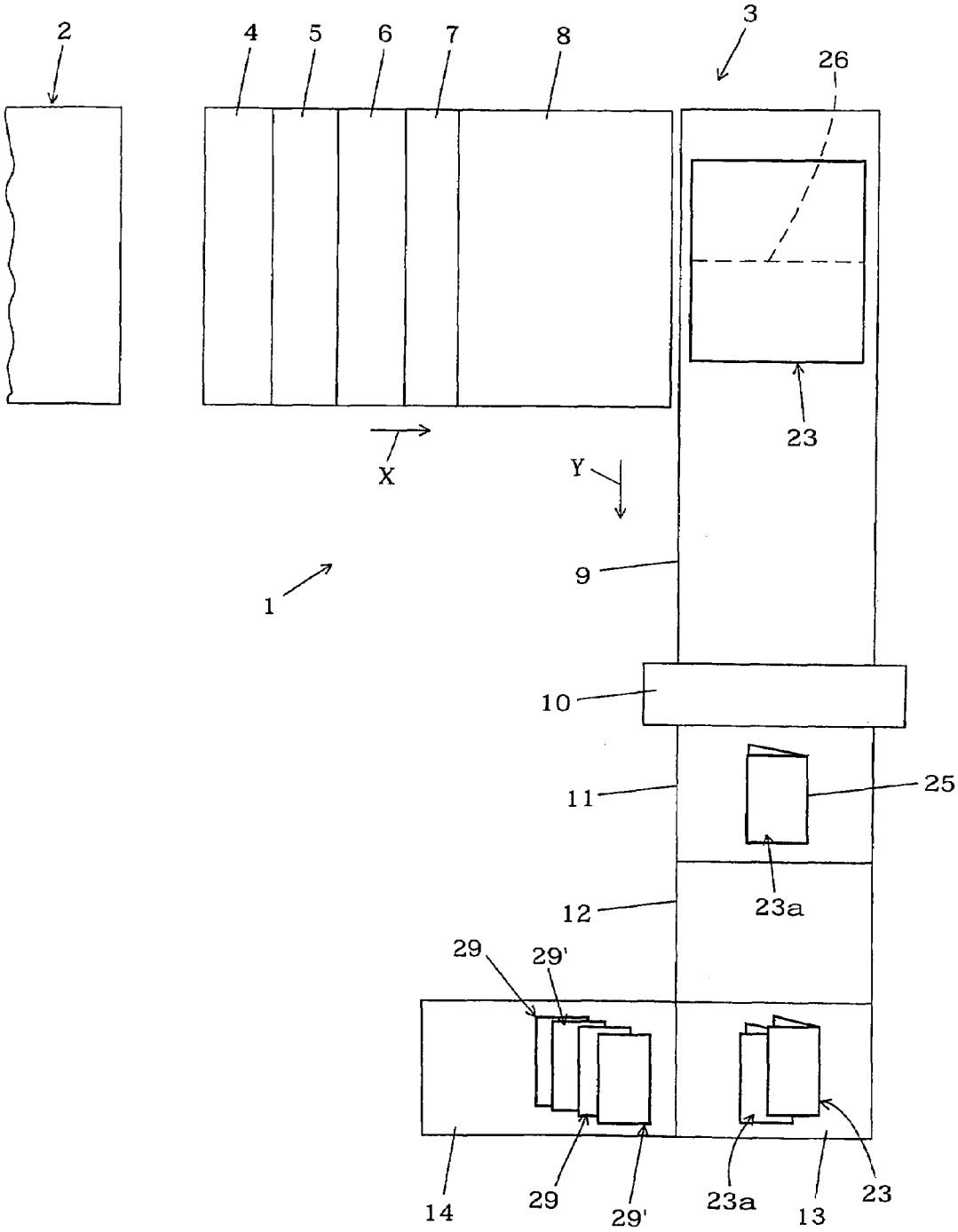

In the following text, the invention will be explained in more detail by using the drawings, in which, purely schematically:

FIG. 1 shows a plan view of an apparatus for producing various types of newspapers, FIG. 2 shows the progress of a first embodiment of the method according to the invention for producing newspapers, FIG. 3 shows a plan view of the apparatus according to FIG. 1 for implementing the method illustrated in FIG. 2, FIG. 4 shows the progress of a second exemplary embodiment of the method according to the invention for producing newspapers, FIG. 5 shows a plan view of the apparatus according to FIG. 1 for implementing the method illustrated in FIG. 4, and FIGS. 6-10 show the progress of further exemplary embodiments of the method according to the invention in illustrations corresponding to FIG. 2.

In FIG. 1, an apparatus 1 for producing newspapers is shown purely schematically in plan view. Using this apparatus 1, it is possible to produce various types of newspapers, that is to say those of different format or different composition, without changes relating to the system.

This apparatus 1 has a digital printing system 2, which is of a design known per se and in which a material web is printed region by region, as will be described in more detail. This digital printing system 2 is followed by a further processing system 3, which has a side edge cutting station 4, a longitudinal cutting station 5, a crosscutting station 6, a removal device 7 and a first collecting station 8. The stations 4-8 are arranged one after another as seen in a first conveying direction X. The side edge cutting station 4 is used to cut a material strip away from the printed material web along a side edge or along both side edges. In the longitudinal cutting station 5, the material web is cut in its longitudinal direction, while cutting of the material web transversely with respect to its longitudinal direction is carried out in the crosscutting station 6. The removal device 7 is used to remove damaged, empty and wrongly printed sheets (rejects) from the processing path. In the first collecting station 8, the sheets separated from the material web are placed on one another in order to form a section in each case. The first collecting station 8 can be of the type described in EP-A-1 471 022, for example. The side edge cutting station 4 and the longitudinal cutting station 5 can be deactivated from case to case, so that the material web is not trimmed at its side edges or not cut in its longitudinal direction, if this is not required for the production of a specific newspaper.

The first collecting station 8 is followed by a conveying device 9, whose conveying direction Y is at right angles to the conveying direction X. The conveying device 9 moves the sections coming from the first collecting station 8 to a crossfolding station 10, in which the superimposed sheets of a section are folded transversely with respect to the conveying direction Y. The crossfolding station 10 is followed by a longitudinal folding station 11, which is used to fold the sheets of a section in the conveying direction Y. The crossfolding station 10 and/or the longitudinal folding station 11 can have a folding apparatus as described in EP-A-1 213 245. The longitudinal folding station 11 is followed by a stitching station 12, in which the sections coming from the longitudinal folding station 11 are stitched along their folded edge. Instead of a folding station 12, other types of stations, e.g. a gluing station, can also be used for joining the folded sheets of a section lying inside one another.

The stitching station 12 is followed by a second collecting station 13, in which two or more sections are inserted into one another. The finished newspapers are delivered at a delivery station 14.

The crossfolding station 10, the stitching station 12 and the second collecting station 13 can be deactivated from case to case if, during the production of certain types of newspapers, crossfolding, stitching and/or interleaving of sections is not required.

The production of various types of newspapers by using the apparatus 1 will now be explained by using FIGS. 2-8.

FIG. 2 shows the progress of a first embodiment of the method according to the invention for producing newspapers, while the apparatus 1 according to FIG. 1 during the implementation of the method according to FIG. 2 is illustrated in FIG. 3.

In the exemplary embodiment according to FIG. 2, newspapers in what is known as tabloid format are produced, all the newspapers being of the same type, consisting of two folded sheets lying one inside the other, and thus having 8 pages.

A material web 15 is drawn off a roll 16 and printed on both sides in the digital printing system 2, which is illustrated only schematically in FIG. 2. In the process, the information in the longitudinal direction of the material web 15 is printed onto the latter. 17, 17', . . . 17'''' designate successive portions of the material web 15. The printing of the material web 15 is carried out in successive regions 18, 18*a*, . . . 18*j*. Each of these regions 18, 18*a*, . . . 18*j* is subdivided into two subregions 19 and 19', 19*a* and 19*a'* and so on, which lie beside one another in the longitudinal direction of the material web 15. The two subregions 19, 19' and 19*a*, 19*a'* in each case lying beside one another and belonging to each region 18, 18*a*, . . . 18*j* each correspond to one sheet of a section. These two sheets of a section are respectively designated A, B and A', B'. In the exemplary embodiment according to FIG. 2, in each case each portion 17, 17' . . . 17"" is printed successively with the information which is assigned to the sheets of two different sections. Expressed in other words, the sheets designated A and B in each portion 17-17"" belong to a first section, and the sheets designated B' and B' in each portion 17-17"" belong to a second section.

The material web 15 printed in this way is cut in its longitudinal direction in the longitudinal cutting station 5, as illustrated by the scissors 20. The material web 15 is then cut in the transverse direction in the crosscutting station 6, as indicated by the scissors 21. As a result, two adjacent sheets 22, 22' are produced, which then reach the first collecting station 8.

In this collecting station 8, the sheets 22 and 22' beside one another of a section are then placed on one another. The sections 23 and 23' formed in this way then reach the conveying device 9, with which they are conveyed further in the direction of the arrow Y.

The sections 23, 23' pass through the crossfolding station 10, deactivated in this case, and are folded in the longitudinal direction along the fold lines 24 in the longitudinal folding station 11. As FIG. 3 shows, these fold lines 24 run in the conveying direction Y. In the following stitching station 12, the sections 23, 23' are stitched along their longitudinal fold 25. If this stitching is to be omitted, then the stitching station 12 is deactivated. The sections 23, 23' run through the deactivated second collecting station 13 and are delivered in the delivery station 14 in the order section 23, section 23', section 23, section 23' and so on. The sections 23, 23' simultaneously form the finished newspapers 29, 29'.

In this exemplary embodiment, the side edge cutting station 4, the crosscutting station 10, the second collecting station 13 and if need be the stitching station 12 are deactivated. No processing of the material web 15 or of the sections 23, 23' is carried out in these deactivated stations.

In FIGS. 4 and 5, in illustrations which correspond to the illustrations in FIGS. 2 and 3, the production of newspapers which have a format other than the newspapers or sections 23, 23' according to FIGS. 2 and 3 is illustrated. By using the exemplary embodiment according to FIG. 4 it will be explained how newspapers in what is known as broadsheet format are produced, specifically newspapers of a different type.

The material web 15 drawn off the roll 16 is printed on both sides in successive regions 18, 18*a*, . . . 18*m*. Each of these regions 18, 18*a*, . . . 18*m* corresponds to one sheet of a section. The information is printed onto the material web 15 transversely with respect to the longitudinal direction of the latter. The regions A-D of the material web portion 17 belong to a first section, which consists of four sheets and a total of 16 pages. The regions E-J of the following material web portion 17' belong to a second section, which comprises six sheets and a total of 24 pages. The regions A'-D' of the portion 17" belong to a further section, which corresponds to the first section.

In the present exemplary embodiment, it will be assumed that the width of the material web 15 is greater than the width of the printed regions 18, . . . 18*m*, that is to say greater than the width of the sheets 22. For this reason, as the material web 15 passes through the side edge cutting station 4, portions of material are cut away laterally from the material web 15. This is indicated in FIG. 4 by means of the two cutting tools (scissors) 30, 31. The following longitudinal cutting station 5 is deactivated, that is to say no longitudinal cutting of the material web 15 is carried out. In the crosscutting station 6, the material web 15 is cut transversely with respect to its longitudinal direction (illustrated by the scissors 21 in FIG. 4). The sheets 22 separated from the material web 15 in this way reach the first collecting station 8, in which the sheets 22 of a section are placed on one another. The superimposed sheets 22 of a section then pass onto the conveying device 9 and are conveyed in the conveying direction Y by the latter. The sections consisting of the sheets A-D, A'-D' are designated 23, while the sections which are formed by the sheets E-J are designated 23*a*.

The sections 23, 23*a* pass successively through the crossfolding station 10, in which the superimposed sheets of a section 23, 23*a* are folded along the fold line 26. The crossfold produced in this case is designated 27.

The once-folded sections 23, 23*a* are then folded along a fold line 28, which runs at right angles to the crossfold 27, in the subsequent longitudinal folding station 11. The corresponding longitudinal fold is designated 25. In the second collecting station 13, in each case two twice-folded sections 23*a*, 23 are placed in one another to form a finished newspaper 29. Here, in each case one section 23 is placed on the preceding section 23*a* in the second collecting station 13.

The finished newspapers 29, 29' are delivered in the delivery station 14. Each of these newspapers 29, 29' thus consists of two sections 23 and 23*a* inserted into each other, the section 23*a* comprising the sheets A-D and the section 23 comprising the sheets E-J.

In the exemplary embodiment illustrated in FIGS. 4 and 5, with the exception of the longitudinal cutting station 5, all the processing stations 4, 6, 8, 10, 11, 12, 13 are activated.

By using FIGS. 6-9, which correspond to the illustrations of FIGS. 2 and 4, further exemplary embodiments for producing various types of newspapers will now be explained.

Figure 6:
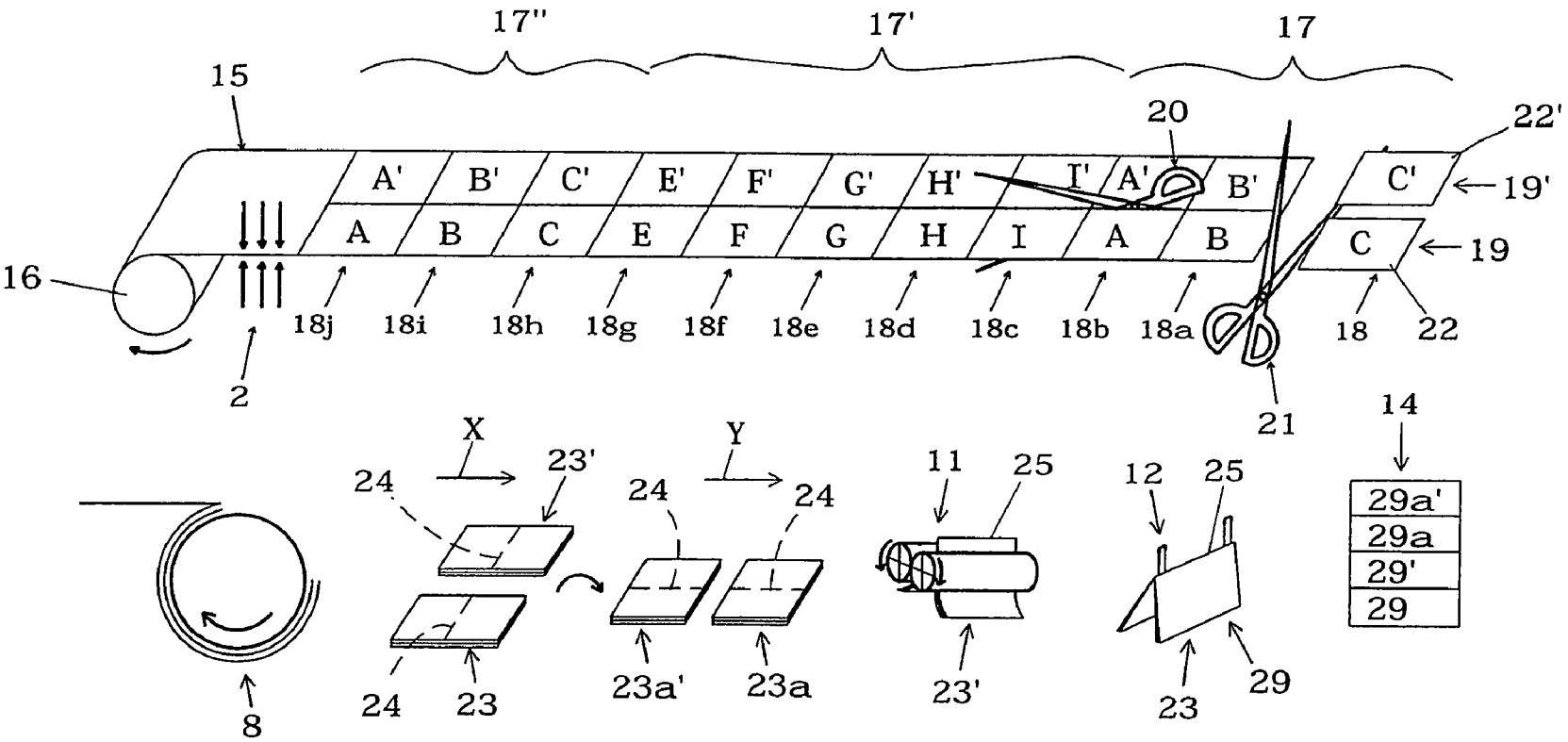

The exemplary embodiment shown in FIG. 6 corresponds to the exemplary embodiment according to FIG. 2 but, in the exemplary embodiment according to FIG. 6, with different end products, that is to say newspapers 29, being produced. The regions 18, 18*a*, 18*b* and 18*h*, 18*i*, 18*j* of the material web portions 17 and 17" belong to sections which comprise three sheets 22 and 22' and thus 12 pages, while the regions 18*c*, 18*d*, 18*e*, 18*f*, 18*g* of the material web portion 17' belong to a section which comprises five sheets 22, 22' and thus 20 pages.

In the same way as in the exemplary embodiment according to FIG. 2, in each region 18, 18*a*, . . . 18*j* two adjacent subregions 19, 19' are printed which belong to different sections. Here, in each subregion 19, 19', the information is printed in the longitudinal direction of the material web 15.

The printed material web is cut in its longitudinal direction in the longitudinal cutting station 5 (illustrated by the scissors 20). Crosscutting in the crosscutting station 6 is then carried out (illustrated by the scissors 21). The sheets 22, 22' separated in this way, lying beside one another and belonging to various sections, reach the first collecting station 8, in which the sheets are placed on one another to form sections 23 and 23'. The sections 23, 23' are then conveyed by means of the conveying device 9 (FIG. 3) to the longitudinal folding station 11, in which the superimposed sheets of the sections 23 are folded along the fold lines 24 in the direction of their movement Y. The longitudinal fold produced in the process is designated 25. The folded sections 23 are then stitched at the folded edge 25 in the stitching station 12. This stitching can be omitted if need be. In the delivery station 14, the end products 29, 29', 29*a*, 29*a'* and so on are delivered successively. In this case, the end products 29, 29' consist of one section which consists of the sheets A, B, C and A', B', C'.

By contrast, the newspapers 29*a*, 29*a'* each comprise one section which comprises the sheets E-I and E'-I'.

In the same way as in the exemplary embodiment according to FIG. 2, in the exemplary embodiment according to FIG. 6 the side edge cutting station 4, the crossfolding station 10 and the second collecting station 13 and, if need be, the stitching station 12 as well, are deactivated.

Figure 7:
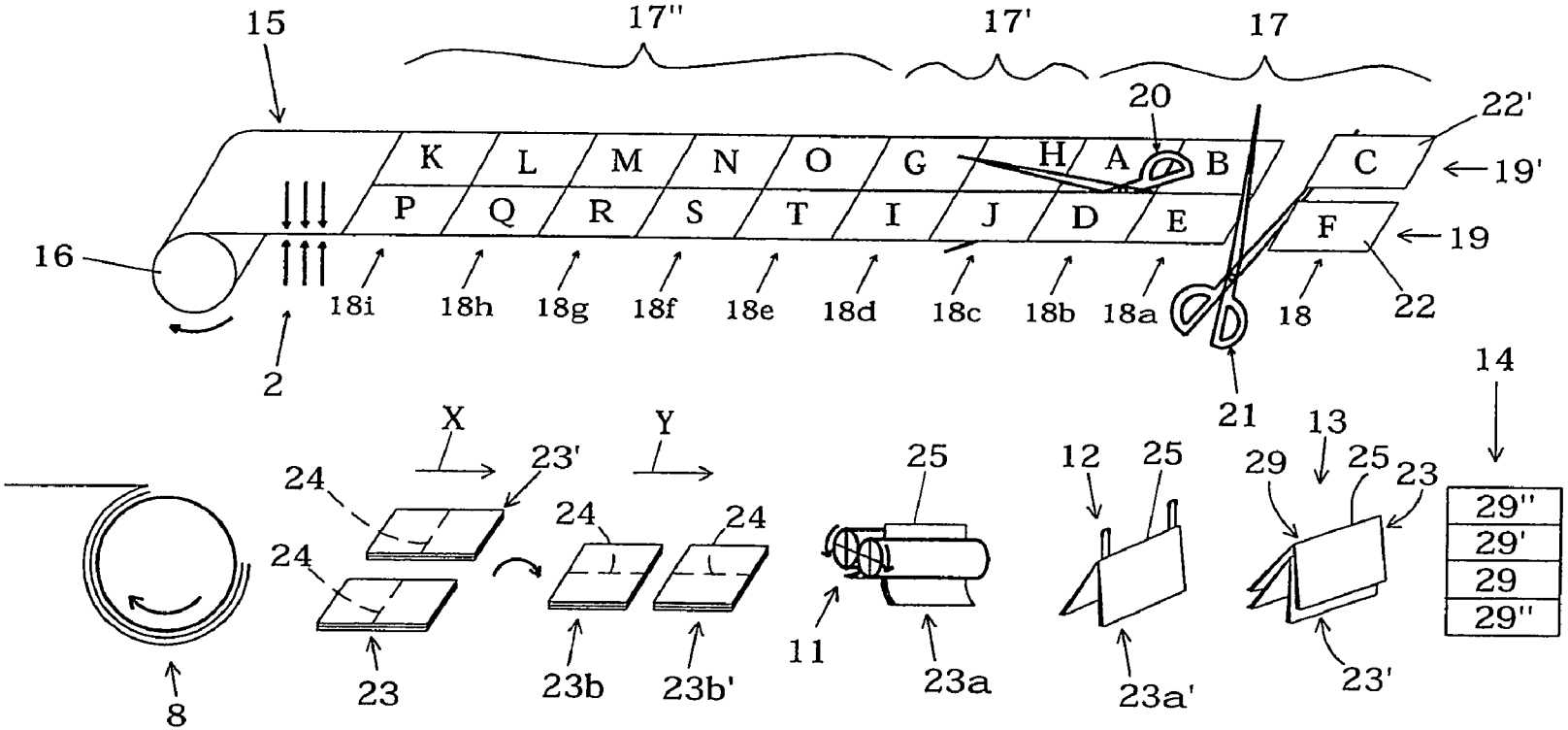

The exemplary embodiment shown in FIG. 7 largely corresponds to the exemplary embodiment according to FIG. 6 described previously, with the exception that end products, that is to say newspapers 29, which consist of two sections lying inside one another are produced.

The regions 18, 18*a*, 18*b* (and the associated subregions 19, 19') of the material web portion 17 belong to a first newspaper, the regions 18*c* and 18*d* of the material web portion 17' belong to a second newspaper, and the regions 18*e*-18*i* of the material web portion 17" belong to a third newspaper. In this case, the subregions 19' of the regions 18, 18*a*, 18*b* (designated A, B, C) correspond to a first section 23, and the subregions 19 of the regions 18, 18*a*, 18*b* (designated D, E, F) correspond to a second section 23' of the first newspaper 29. The subregions 19' of the regions 18*c* and 18*d* (designated G and H) correspond to a first section 23*a*, and the subregions 19 of the regions 18*c*, 18*d* correspond to a second section 23*a'* of the second newspaper 29'. Finally, the subregions 19' of the regions 18*e*-18*i* (designated K, L, M, N, O) correspond to a first section 23*b*, and the subregions 19 of the regions 18*e*-18*i* (designated P, Q, R, S, T) correspond to a second section 23*b'* of the third newspaper 29".

As explained by using FIG. 6, the material web printed with information in its longitudinal direction is first cut in the longitudinal direction (scissors 20) and then in the transverse direction (scissors 21). The sheets 22, 22' lying beside one another are placed on one another in the first collecting station 8. The sections 23, 23' lying beside one another are transferred to the conveying device 9 and fed one after another to the longitudinal folding station 11 in the conveying direction Y (illustrated in FIG. 7 by the sections 23*b'* and 23*b*). In the longitudinal folding station 11, folding along the fold lines 24 is carried out. If desired, the sections are stitched along their longitudinal fold 25 in the stitching station 12 (illustrated in FIG. 7 by the section 23*a'*). The sections belonging to the same newspaper and stitched if need be are then placed astride one another in the second collecting station 13, that is to say inserted into one another, as illustrated in FIG. 7 by the sections 23, 23'. The end product (newspaper 29) formed in this way is delivered at the delivery station 14, that is to say in the order first newspaper 29, second newspaper 29', third newspaper 29", fourth newspaper 29, which corresponds to the first newspaper, and so on. In this case, both sections 23, 23' of a newspaper 29 or only one of the two sections 23, 23' or 23*a*, 23*a'* can be stitched.

In the exemplary embodiment according to FIG. 7, the following stations are deactivated: side edge cutting station 4, crossfolding station 10 and, if need be, stitching station 12.

By using FIG. 8, it will now be explained how, using the apparatus 1 according to FIG. 1, a newspaper 29 which is produced from different types of partial products can be produced. The material web 15 is printed as follows (on both sides):

In the material web portion 17, in each region 18, 18*a*, 18*b*, two subregions 19, 19' lying beside each other are printed. The subregions 19' of the regions 18, 18*a*, 18*b* (designated A, B, C) correspond to the sheets 22' of a first section 23 of a first partial product 34, while the subregions 19 of the regions 18, 18*a*, 18*b* correspond to a second section 23' of the first partial product 34 mentioned. This first partial product 34 is of the format of a tabloid product and therefore comprises two sections 23, 23', each of which comprises three sheets and a total of 12 pages.

In the material web portions 17', 17" and 17'", regions 18*c*-18*l* are printed, of which the regions 18*c*, 18*d*, 18*e* correspond to the sheets of a second partial product, that is to say of a section 23*a*. The regions 18*f* and 18*g* correspond to sheets of a third partial product, that is to say of a section 23*b*, while the regions 18*h*-18*l* correspond to the sheets of a fourth partial product, that is to say of a section 23*c*. These sections 23*a*, 23*b*, 23*c* have a broadsheet format.

Figure 8:
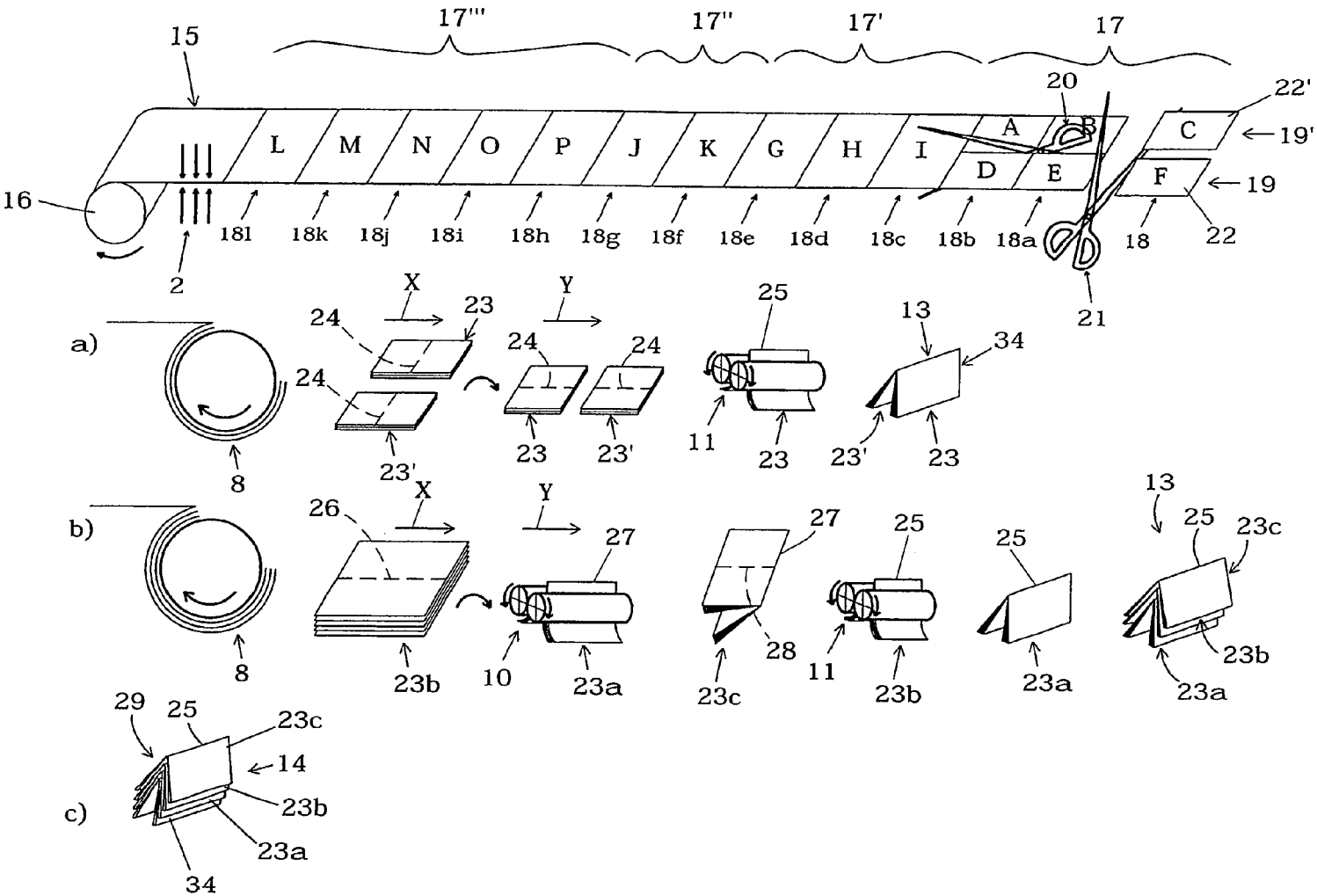

As FIG. 8 shows, the material web 15 in the portion 17 is cut both in the longitudinal direction (scissors 20) and in the transverse direction (scissors 21). The sheets 22, 22' arising beside one another, as has been described above by using FIG. 7, are placed on one another in the first collecting station 8 (sections 23, 23') and are subsequently folded along the fold lines 24 in the longitudinal folding station. In the second collecting station 13, the sections 23', 23 belonging to the partial product 34 are placed on one another, that is to say inserted into one another. The finished partial product 34 initially remains in the second collecting station 13. During the processing of the sheets 22, 22' formed from the material web portion 17, the crossfolding station 10 and, if need be, the stitching station 12 as well, remain deactivated.

As soon as the material web section 17 has passed through the longitudinal cutting station 5 (FIG. 1), the longitudinal cutting station 5 is deactivated, since longitudinal cutting of the following material web sections 17', 17", 17'" is not required. If necessary, the side edge cutting station 4 can then be activated in order to cut lateral material strips away, as has been explained by using FIG. 4. The material web portions 17', 17", 17'" are cut in the transverse direction (scissors 21) and fed to the first collecting station 8, where the sheets of a section 23*a*, 23*b*, 23*c* in each case are placed on one another. Then, in the crossfolding station 10, which has been activated in the meantime, folding of the superimposed sheets of a section along the fold line 26 is carried out, as has already been explained by using FIG. 4. In the following longitudinal folding station 11, further folding of the sheets of a section along the fold line 28 is carried out. In the second collecting station 13, the twice-folded sections 23*a*, 23*b* and 23*c* are placed one after another on the partial product 34 already located in this second collecting station 13. In this way, an end product, that is to say a newspaper 29, is obtained which consists of the partial product 34 and the sections 23*a*, 23*b* and 23*c*.

As emerges from the preceding description of the exemplary embodiment according to FIG. 8, with an apparatus 1 according to FIG. 1 it is possible to produce various types of partial products 34, 23*a*, 23*b*, 23*c* without continuous production having to be interrupted. This is because it is necessary only to connect and disconnect certain stations, specifically the side edge cutting station 4, the longitudinal cutting station 5, the crossfolding station 10, the stitching station 12, at the correct time during production.

It goes without saying that, in the same way, without interrupting production, other newspapers which differ from one another in format and/or in composition can also be produced. In the previously described exemplary embodiments for producing newspapers, use is made of an apparatus 1 as illustrated in FIG. 1. In this apparatus 1, the conveying direction of the stack of sections ejected from the first collecting apparatus 8, that is to say the superimposed sheets of a section 23, is changed through 90°. This means that the conveying direction Y of the sections 23 is at right angles to the direction of movement X of the material web 15 and to the direction X in which the sheets 22, 22' separated from the material web 15 are fed to the first collecting station 8. In this embodiment, the processing path is thus angled.

However, it is also possible to refrain from such a change in the conveying direction X, Y and to arrange the processing stations along a linear processing path. In this case, the conveying directions X and Y are oriented identically.

Figure 9:
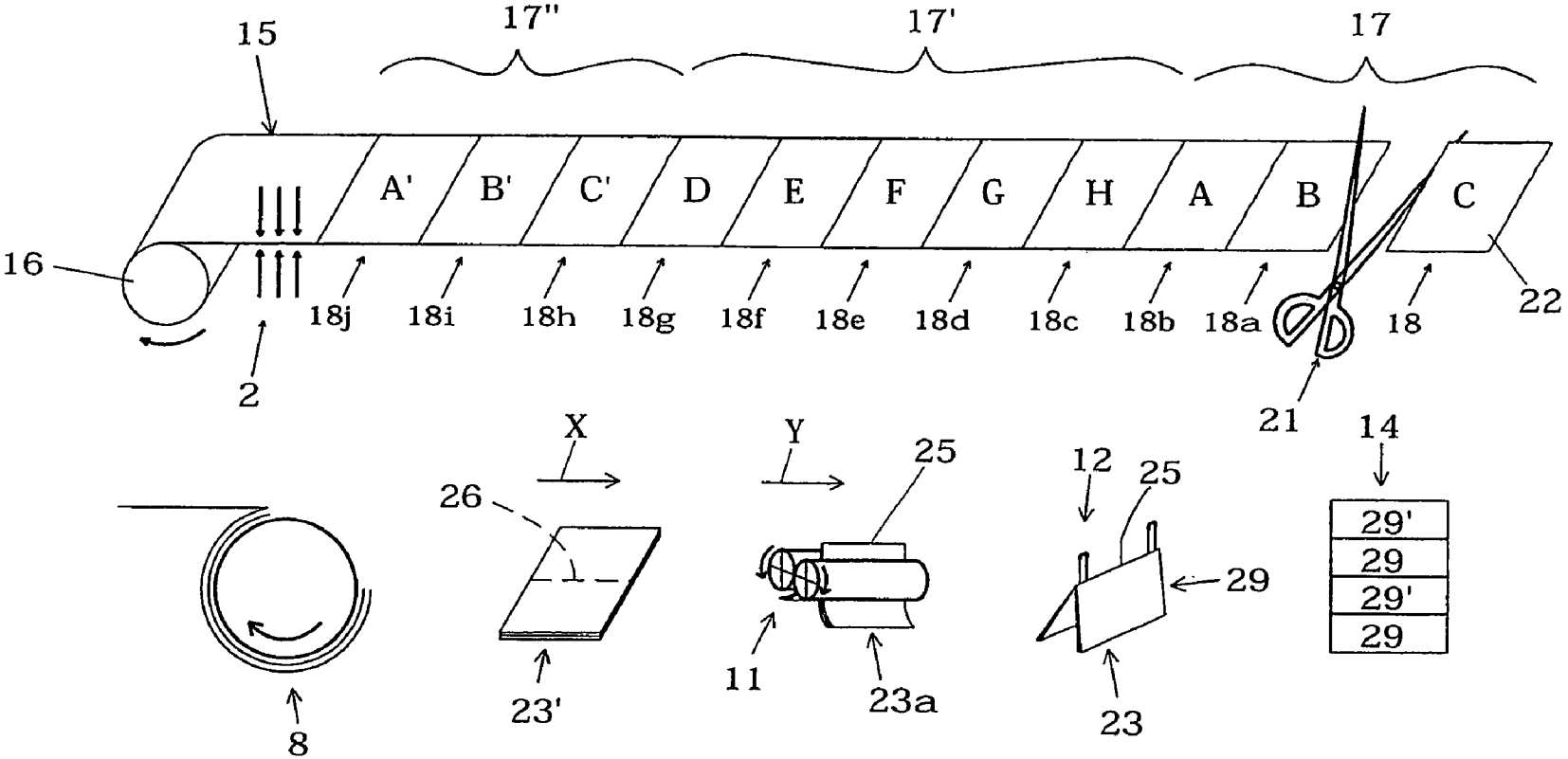

By using FIGS. 9 and 10, which correspond to the illustration of FIG. 2, exemplary embodiments in which the processing path is linear will now be described.

By using FIG. 9, the production of newspapers 29, 29' in the tabloid format will be described, the information in the individual regions 18, 18*a*, . . . 18*j* being printed transversely with respect to the longitudinal direction of the material web 15. The regions 18, 18*a*, 18*b* of the material web portion 17 and the regions 18*h*, 18*i*, 18*j* of the material web portion 17" (designated A, B, C and A', B', C' respectively) correspond to the sheets of a first section, while the regions 18*c*-18*g* of the material web portion 17' (designated D, E, F, G, H) correspond to the sheets of a second section. The first section consists of three sheets and a total of 12 pages, while the second section consists of five sheets and a total of 20 pages.

The printed material web 15 passes through the deactivated side edge cutting station 4 and the deactivated longitudinal cutting station 5 and is cut in the transverse direction in the crosscutting station 6 (scissors 21). The sheets 22 separated in the process reach the first collecting station 8, where the sheets of a section are placed on one another. The superimposed sheets of a section are then conveyed in the same direction through the deactivated crossfolding station 10 to the longitudinal folding station 11, where they are folded along the fold line 26. The longitudinal fold produced in the process is designated 25. The folded sections 23 are stitched along the longitudinal fold 25 in the following stitching station 12. If appropriate, this stitching can be omitted. The sections 23 pass through the deactivated second collecting station 13 and are delivered at the delivery station 14 as finished newspapers 29, 29'.

In the above described embodiment, as already mentioned, the processing stations 4, 5, 6, 8, 10, 11, 12, 13 are arranged along a linear processing path, that is say the conveying directions X and Y are aligned with each other. In the present case, of these processing stations only the cross-cutting station 6, the first collecting station 8, the longitudinal folding station 11 and, if appropriate, the stitching station 12 are activated.

By using FIG. 10, the production of different newspapers 29, 29' in broadsheet format will now be explained, the information in the individual regions 18, 18*a*, . . . 18*n* being printed in the longitudinal direction of the material web 15. The regions 18-18*c* of the material web portion 17 and, respectively, the regions 18*j*-18*m* of the material web portion 17" (designated A, B, C, D and A', B', C', D' respectively) correspond to the sheets of a first section 23, while the regions 18*d*-18*i* of the material web portion 17 and, respectively, the regions 18*n* and those following of the material web portion 17'" (designated E, F, G, H, I, J and J') correspond to the sheets of a second section 23*a*. The first section 23 consists of four sheets and thus comprises 16 pages, while the second section 23*a* consists of six sheets and thus comprises 24 pages. The material web 15 is trimmed at the side edges in the side edge cutting station 4 if necessary, passes through the deactivated longitudinal cutting station 5 and is cut in the transverse direction in the crosscutting station. The sheets 22 arising in the process reach the first collecting station 8, in which the sheets of a section are placed on one another (see the section designated 23*a*). The sections consisting of sheets lying one above another are conveyed in the same direction to the crossfolding station 10, in which the sections are folded transversely with respect to their conveying direction Y, along the fold line 32. The corresponding crossfold is designated 27. The sections then reach the longitudinal folding station 11, where they are folded along the fold line 33, which runs in the conveying direction Y. The longitudinal fold formed in the process is designated 25. The twice-folded sections then reach the second collecting station, where in each case a first section 23 is placed on a second section 23*a*. The finished newspapers 29, 29', which each consist of two sections 23, 23*a* lying in one another, are delivered in the delivery station 14.

Figure 10:
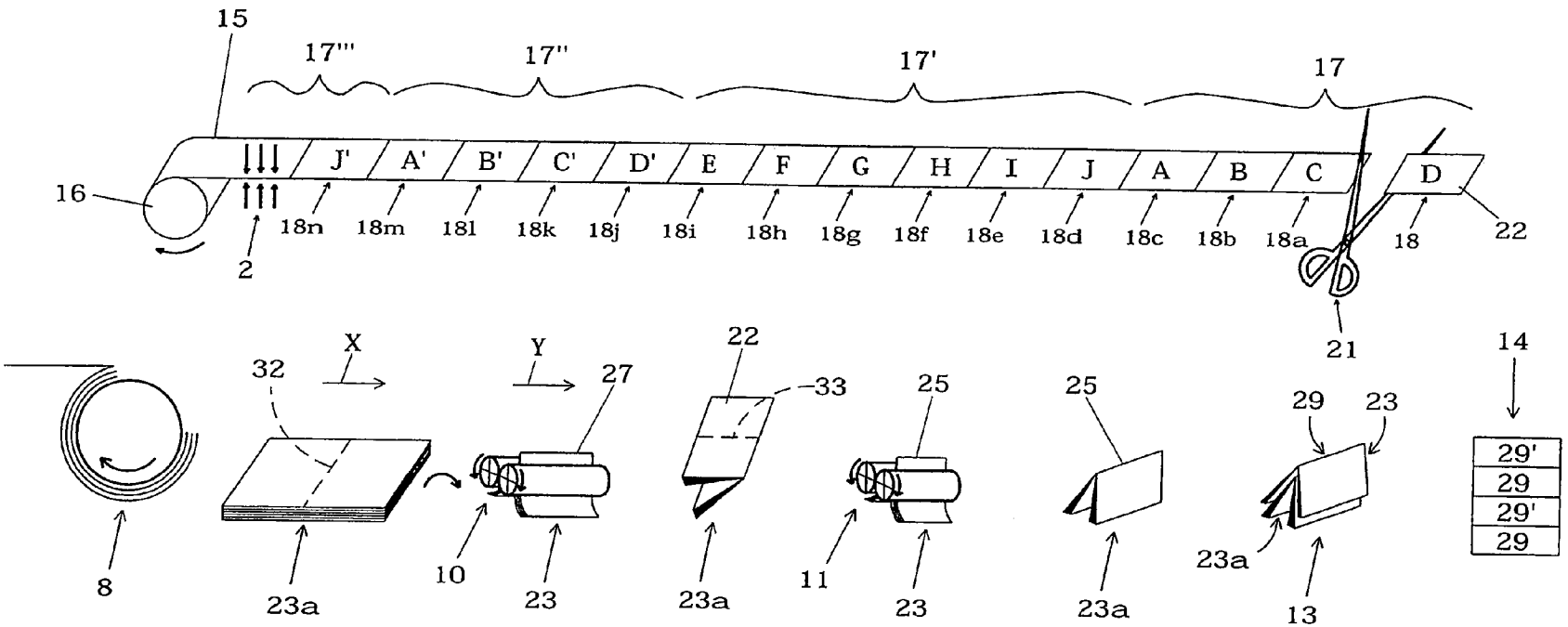

In the exemplary embodiment according to FIG. 10, the following stations are activated: crosscutting station 6, first collecting station 8, crosscutting station 10, longitudinal folding station 11, second collecting station 13 and, if appropriate, also the side edge cutting station 4.

Using the apparatus 1, with a continuous production process, various types of newspapers can be produced one after another or in parallel with one another, irrespective of whether the processing path is angled, as shown in FIG. 1, or runs linearly. The various newspapers can differ with respect to format (tabloid format, broadsheet format, Berliner format, Nordic format and so on) and/or in terms of composition (one section or a plurality of sections). The sections can be folded once or twice and, if necessary, stitched.

In the following, some of the various possible variants will be described briefly. The side edge cutting station 4 can be constructed in such a way that a material strip is cut away only at one side edge of the material web 15. The cutting tool or cutting tools of the side edge cutting station 4 are preferably adjustable in a direction transverse with respect to the longitudinal extent of the material web 15.

In certain cases, the side edge cutting station 4 and the longitudinal cutting station 5 form a common structural unit. In this case, the cutting tool or the cutting tools of the side edge cutting station 4 and the cutting tool of the longitudinal cutting station 5 are mounted on a common shaft which extends transversely with respect to the longitudinal direction of the material web 15. The various cutting tools are activated individually as required.

It also possible to color the material web 15 before or after printing. To this end, a commercially available coloring unit can be provided before or after the digital printing system 2.

Instead of moving the stack of superimposed sheets 22 of a section 23 into the correct attitude for the following folding as described by using the apparatus 1 shown in FIG. 1 by means of changing the conveying direction X, Y, the stacked sheets of the sections 23 can be rotated through 90° and then fed to the following folding stations 10, 11 in the same conveying direction.

In all the exemplary embodiments explained above, the sections 23 are always folded in the longitudinal folding station 11 and only in certain cases in the crossfolding station 10. However, it is also conceivable to fold the sections 23 always in the crossfolding station 10 and only in certain cases in the longitudinal folding station 11. In this case, the stitching station 12 is constructed in such a way that stitching along the crossfold is possible.

It is possible to insert previously produced inserts into the sections 23 and/or between sections 23 inserted into one another. These inserts are generally produced at a different location.

The longitudinal folding station 1 can also be constructed in such a way that a number of folded sheets are placed on one another before they are conveyed onward to the next processing station. This is possible, for example, with a folding apparatus as shown in EP-A-1 213 245 (FIGS. 4a, 4b).

The invention claimed is:

1. A method for producing newspapers which comprise at least one section which is formed from a number of folded printed sheets located inside one another, the method comprising the steps of:

printing in a digital printing system, on both sides of a material web, successive regions of the material web, of which each region corresponds to at least one sheet of a section, information belonging to the corresponding at least one sheet, and processing the printed material web in a further processing system, the processing comprising:

determining if a step of longitudinally cutting the material web is required based on the type of production, format, and/or composition of a newspaper to be printed, when it is determined that the step of longitudinally cutting the material web is required, longitudinally cutting the material web in a longitudinal cutting station in which the material web is cut in its longitudinal direction, crosscutting the material web in a crosscutting station in which the material web is cut transversely with respect to its longitudinal direction, collecting the sheets in a first collecting station in which, for each section, sheets of the section are placed on one another, determining if a step of crossfolding the sheets is required based on the type of production, format, and/or composition of the newspaper to be printed, when it is determined that the step of crossfolding the sheets is required, crossfolding the sheets in a crossfolding station in which, for each section, the collected sheets of the section are folded transversely with respect to a direction of movement of the sheets, determining if a step of longitudinally folding the sheets is required based on the type of production, format, and/or composition of the newspaper to be printed, when it is determined that the step of longitudinally folding the sheets is required, longitudinally folding the sheets in a longitudinal folding station in which, for each section, the collected sheets of the section are folded in the direction of movement of the sheets, determining if a step of collecting the sheets in a second collecting station is required based on the type of production, format, and/or composition of the newspaper to be printed, when it is determined that the step of collecting the sheets in a second collecting station is required, collecting the sheets in the second collecting station in which a number of sections, each formed of folded sheets, are inserted into one another to produce a finished newspaper, and delivering the finished newspaper by a delivery station, wherein, from case to case, the step of longitudinally cutting the material web in the longitudinal cutting station and/or the step of crossfolding the collected sheets in the crossfolding station and/or the step of longitudinally folding the collected sheets in the longitudinal folding station and/or the step of collecting the sheets in the second collecting station are omitted, based on the type of production, format, and/or composition of the newspaper to be printed.

2. The method as claimed in claim 1, wherein the folded sheets of a section are joined to one another along the fold.

3. The method as claimed in claim 2, wherein the folded sheets of the section are joined by means of stitching.

4. The method as claimed in claim 1, wherein a material strip is cut away from the material web at one side edge or both side edges of the latter.

5. The method as claimed in claim 4, wherein the material strip is cut away from the material web at one side edge or both side edges of the latter after the printing of the material web.

6. The method as claimed in claim 1, wherein subregions lying beside one another in the successive regions of the material web, of which each subregion corresponds to one sheet of a section, are printed with information, the printed material web being processed by the following steps in the following order:

longitudinally cutting the printed material web in the longitudinal cutting station;

crosscutting the printed material web in the crosscutting station;

collecting the sheets of a section in each case by placing the sheets on one another in the first collecting station;

longitudinally folding the collected sheets of a section in each case one after another in the longitudinal folding station; and delivering the finished newspaper at the delivery station.

7. The method as claimed in claim 1, wherein the method comprises the following steps in the following order:

printing subregions lying beside one another in the successive regions of the material web with information, of which each subregion corresponds to one sheet of a section; longitudinally cutting the printed material web in the longitudinal cutting station;

crosscutting the printed material web in the crosscutting station;

collecting the sheets of a section in the first collecting station by placing the sheets of the section in each case on one another;

longitudinally folding the collected sheets of a section in the longitudinal folding station in each case one after another;

collecting a number of sections in the second collecting station in each case by inserting the number of sections into one another in order to form finished newspapers consisting of at least two sections; and delivering the finished newspapers at the delivery station.

8. The method as claimed in claim 1, wherein the method comprising the following steps in the following order:

crosscutting the material web printed in respectively successive regions in the crosscutting station;

collecting the sheets of a section in the first collecting station in each case by placing the sheets of the section on one another;

crossfolding the collected sheets of a section in the crossfolding station one after another;

longitudinally folding the sheets of a section in the longitudinal folding station;

collecting a number of sections in the second collecting station to form newspapers consisting of at least two sections, by in each case inserting the number of sections into one another; and delivering the finished newspapers at the delivery station.

9. The method as claimed in one of claim 1, wherein the method includes:

crosscutting the material web printed in respectively successive regions in the crosscutting station;

collecting the sheets of a section in each case in the first collecting station by placing the sheets of the section on one another;

longitudinally folding the collected sheets of a section in each case one after another in the longitudinal folding station; and delivering the finished newspaper at the delivery station.

10. The method as claimed in claim 1, the method further comprising:

producing a first partial product in such a way that subregions lying beside one another in the successive regions of a first portion of the material web, of which each subregion corresponds to one sheet of the first partial product, are printed with information, the producing a first partial product comprising the following steps in the following order:

longitudinally cutting the first portion of the printed material web in the longitudinal cuffing station, crosscutting the first portion in the crosscutting station, collecting the sheets of the first partial product in the first collecting station by placing the sheets of the first partial product on one another, and longitudinally folding the collected sheets of the first partial product in the longitudinal folding station;

producing at least one second partial product in such a way that successive regions in the second portion of the material web are printed, the producing at least one second partial product comprising the following steps in the following order:

crosscutting the second portion of the printed material web in the crosscutting station, collecting the sheets of the second partial product in the first collecting station by placing the sheets of the second partial product on one another, crossfolding the collected sheets of the second partial product in the crossfolding station, and longitudinally folding the sheets of the second partial product in the longitudinal folding station;

collecting in the second collecting station the sheets of the second partial product in order to form a newspaper consisting of at least the first and second partial products, by inserting the first partial product and the at least one second partial product into one another in the second collecting station; and delivering the finished newspaper at the delivery station.

11. The method as claimed in claim 1, the method further including coloring the material web before or after the step of printing.

12. The method as claimed in claim 1, wherein the information is printed onto the material web in a direction of a longitudinal extent of the material web or transversely with respect thereto.

13. The method as claimed in claim 1, wherein the method produces both newspapers in tabloid format and newspapers in another format on a same apparatus comprising the digital printing system and the further processing system connected downstream of the digital printing system.

14. The method as claimed in claim 13, wherein the method produces both newspapers in tabloid format and newspapers in broadsheet format, on the same apparatus comprising the digital printing system and the further processing system connected downstream of the digital printing system.

* * * * *